United States Patent [19]

Simpson

[11] 4,078,351

[45] Mar. 14, 1978

[54] CONSTRUCTION SYSTEM

[75] Inventor: Harold Graves Simpson, Oklahoma City, Okla.

[73] Assignee: Star Manufacturing Co. of Oklahoma, Oklahoma City, Okla.

[21] Appl. No.: 336,364

[22] Filed: Feb. 27, 1973

[51] Int. Cl.[2] ..... E04D 1/08; E04D 3/362

[52] U.S. Cl. ..... 52/536; 52/462; 52/591; 52/592

[58] Field of Search ..... 52/536, 539, 540, 592, 52/409-411, 219, 519, 522, 535, 591, 589, 530, 529, 593, 573, 594; 24/213 R, 201 C, 216

[56] References Cited

U.S. PATENT DOCUMENTS

| | | | |
|---|---|---|---|
| 2,756,172 | 7/1956 | Kidd | 24/201 C |
| 3,070,864 | 1/1963 | Pfeffer | 24/201 C |
| 3,088,495 | 5/1963 | Svec | 24/201 C |
| 3,181,300 | 5/1965 | Plummer | 24/201 C |
| 3,381,436 | 5/1968 | Elliott | 52/309 |
| 3,627,600 | 12/1971 | Reiter | 24/201 C |
| 3,694,983 | 10/1972 | Couquet | 52/592 |
| 3,790,993 | 2/1974 | Gilles | 24/201 C |

*Primary Examiner*—John E. Murtagh
*Attorney, Agent, or Firm*—Hubbard, Thurman, Turner, Tucker & Glaser

[57] ABSTRACT

A construction system is disclosed utilizing a prefabricated plank which can be assembled in contiguous, aligned relationship with other similar planks to form a construction section. The individual planks are of varying geometric shapes and are of a composite construction having a structural core with a flexible membrane covering. The core may be formed from foamed plastic, concrete or the like and the membrane a flexible plastic or light gauge metal. The membrane covering includes an edge flap portion adapted to overlie the marginal edge of the next adjacent plank to provide a continuous weatherproof seal between planks. The flaps are sealable by flexible fasteners carried on the membrane flap and marginal portion in the form of interlocking rib and groove elements. The groove and ribs may take various shapes such as a barb and socket and may also include provision for a marginal expansion joint to facilitate assembly of the membrane covering and eliminate expansion and contraction problems caused by temperature changes. In the corner area between adjacent planks, a compressive fastener seals between the converging edge seals to effect a weatherproof exterior. Another form of the edge seal is heat and pressure bonded to weatherproof the system. The interlocking flexible structure is also adaptable to seal overlapping corrugated metal building panels. The individual planks can be assembled to form a roof, wall or any construction section. The present invention also discloses the construction of a geodesic dome using the planks of the present invention.

4 Claims, 15 Drawing Figures

CONSTRUCTION SYSTEM

This invention relates to a building construction system and more particularly relates to a prefabricated building plank structure adapted for assembly with similar planks to form a roof, wall or other construction section.

The construction of roofs and exterior walls by conventional methods is a laborious process usually requiring onsite fabrication and erection of a suitable support structure. Insulation, weatherproofing and exterior sheeting, are applied in place and decorative coverings, if desired, are applied to complete the construction section. Typical of this method of construction are built-up roofing systems which have been employed for many years. With this method of construction, a horizontal roof deck is supported on underlying structural beams. The roof deck is covered by a weatherproof membrane, usually comprising alternate layers of felt and bitumen applied as a field operation, to prevent penetration of moisture into the building interior. Once the membrane is applied to the desired thickness, gravel, rock or similar aggregate material, is spread upon the roof to provide protection against weathering. To reduce heat transfer across the roof deck, insulation is often applied to the underside of the roof at the interior of the building. A wallboard or plasterboard, or other similar finishing material secured at the interior side of the roof, completes the roof structure.

There are many difficulties with building systems of the general type described above. Since this type of construction requires extensive field fabrication, there is little uniformity of quality from one building to another. Construction as described above is expensive and time consuming, requiring a great deal of skilled labor. Sealing and weatherizing the structure is a particular problem.

The disadvantages of such a system are particularly apparent in roofing systems. A built-up roof section as described above is subject to deterioration due to a number of reasons including expansion and contraction from severe temperature changes, moisture trapped below the water membrane, and improper construction techniques. The exterior application of hot tar as a sealant to the roof involves safety and environmental hazards, and for these reasons has become less widely practiced.

In an attempt to overcome the problems inherent in conventional construction methods, it has been suggested to utilize panels which are prefabricated at the factory and are secured together at the job site. The building industry has made limited use of factory prefabricated units which are field assembled. For example, pre-engineered metal panels are commonly used in the construction of certain structures. The corrugated metal panels being lapped and secured by metal fasteners to one another and to a supporting structure. Lapping joints are usually additionally sealed by application of a sealant or mastic.

Roof panels of the prefabricated type generally include some type of insulation such as polystyrene or urethane foam sandwiched between wallboard or asbestos sheeting. A problem arises in sealing these type panels from the weather and water once the panels are arranged in a construction assembly. Often sealing is accomplished by placing a membrane similar to that used in built-up roofing over the roof panels. Obviously such fabrication procedures require considerable field labor and do not entirely avoid the shortcomings of conventional construction systems.

Co-pending patent application entitled ROOF CONSTRUCTION SYSTEM, Ser. No. 336,370, filed concurrently herewith, discloses a prefabricated plank ideally suited for roof construction which utilizes a corrugated metal panel as a structural component. An exterior, weather resistant sheet material is preadhered to the plank exterior. The sheet material is formed with a flap along one or several edges which is adapted to overlie a marginal portion of an adjacent plank. A seal is effected by vulcanization or by virtue of interlocking fastener members carried on the plank and the marginal portion of the next adjacent plank. At the common juncture of several planks a condition exists where several flaps overlie one another. A fastener structure seals the layers together at this juncture which may be reinforced by vulcanization of the overlying members or by inclusion of an appropriate sealant. This novel roof plank represents a substantial improvement over prior art construction methods and prior art roof fabrication. The roof plank disclosed in the co-pending application is a convenient, structurally sound method which when installed provides a weathertight seal at the exterior surface.

The present invention relates to a building construction plank which is prefabricated and adapted for field assembly into a construction section as a roof, wall or similar unit. The present invention provides a composite plank having a core which may be conventional laminated foam, cellular honeycomb or concrete as well as other construction materials such as polymerizable oil in water emulsions. An exterior sheeting or membrane of weatherproof material such as a plastic or light gauge metal is secured to the outer surface of the plank. The membrane is formed with a flap along one or several edges which is adapted to overlie a marginal portion of adjacent panel. The membrane flap is adapted to sealingly engage the marginal portion of the next adjacent plank. At the common juncture of several planks where several flaps overlie one another, a mechanical fastener seals the exterior membrane surface against leakage. The panels may assume any variety of geometric shape such as rectangular, triangular or polygon. The novel combination of the plank structure carrying the sealable membrane flap along with mechanical compressive seal at the juncture of several planks, serves to form a continuous exterior surface which is substantially weatherproof and resistive to moisture. In the preferred form of the invention, the flap and marginal membrane portions are sealable by virtue of male and female interlocking fasteners carried on the respective membrane portions. The interlocking fastener structure may take various forms and may include an expandable section to accommodate field assembly. In another alternate form of the invention, the flap is sealed by bonding.

A further aspect of the present invention provides for the construction of a geodesic dome using complementary construction sections having a core formed of a suitable insulative and structural material. An exterior membrane carries the interlocking fasteners described above. The exterior surface of the dome is conveniently field sealable by engaging the interlocking fastener portions at the time of erection and installation of the dome panel sections.

The plank of the present invention is a highly efficient structural member which can be manufactured with a minimum of labor and a maximum of quality control resulting in an economical product with few field maintenance problems. The plank is highly versatile and can be fabricated with varying characteristics to meet different requirements of strength, weight, thickness, size, shape and thermal conductivity. Field installation can be accomplished by semi-skilled labor using mechanical fasteners and bonding agents. The plank can be altered in the field to meet special requirements by normal drilling, sawing, screwing and cutting operations. The core can be fabricated from a wide selection of conventionally available construction materials.

The above and additional objects and advantages of the present invention will become more apparent by reference to the following specification, claims and appended drawings in which:

Figure 1:
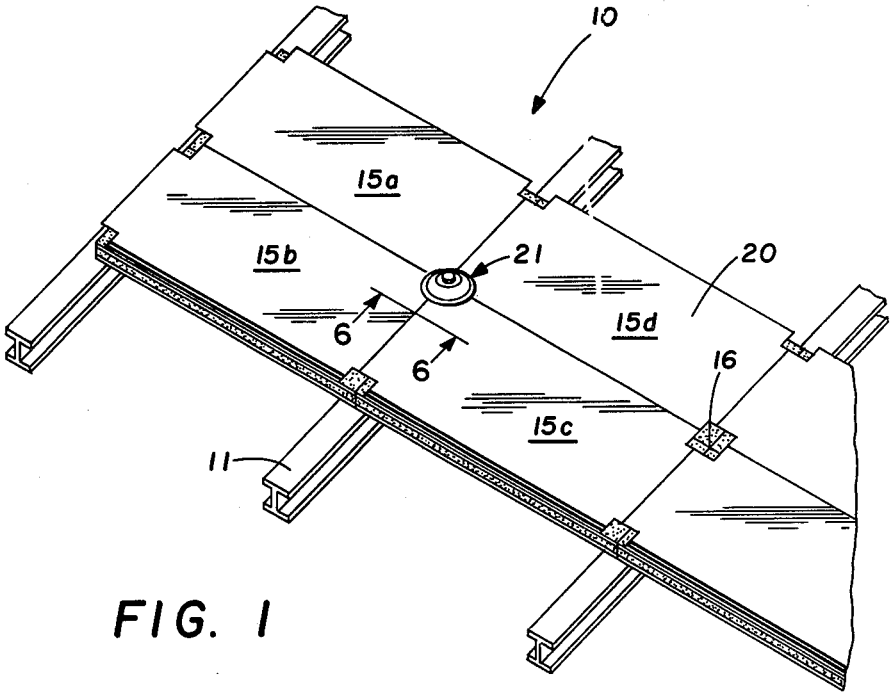
FIG. 1 is a perspective view showing a number of the planks of the present invention assembled to form a typical construction section.

Referring now to the drawings, FIG. 1 shows a construction assembly generally designated by the numeral 10 supported on an underlying series of parallel beams or rafters 11. For purposes of illustration the construction assembly 10 is shown in a horizontal position supported on members 11 as representative of a typical roof structure. However, it should be noted that the assembly could as well be an exterior building wall with the members 11 being vertical studs or beams.

Figure 2:
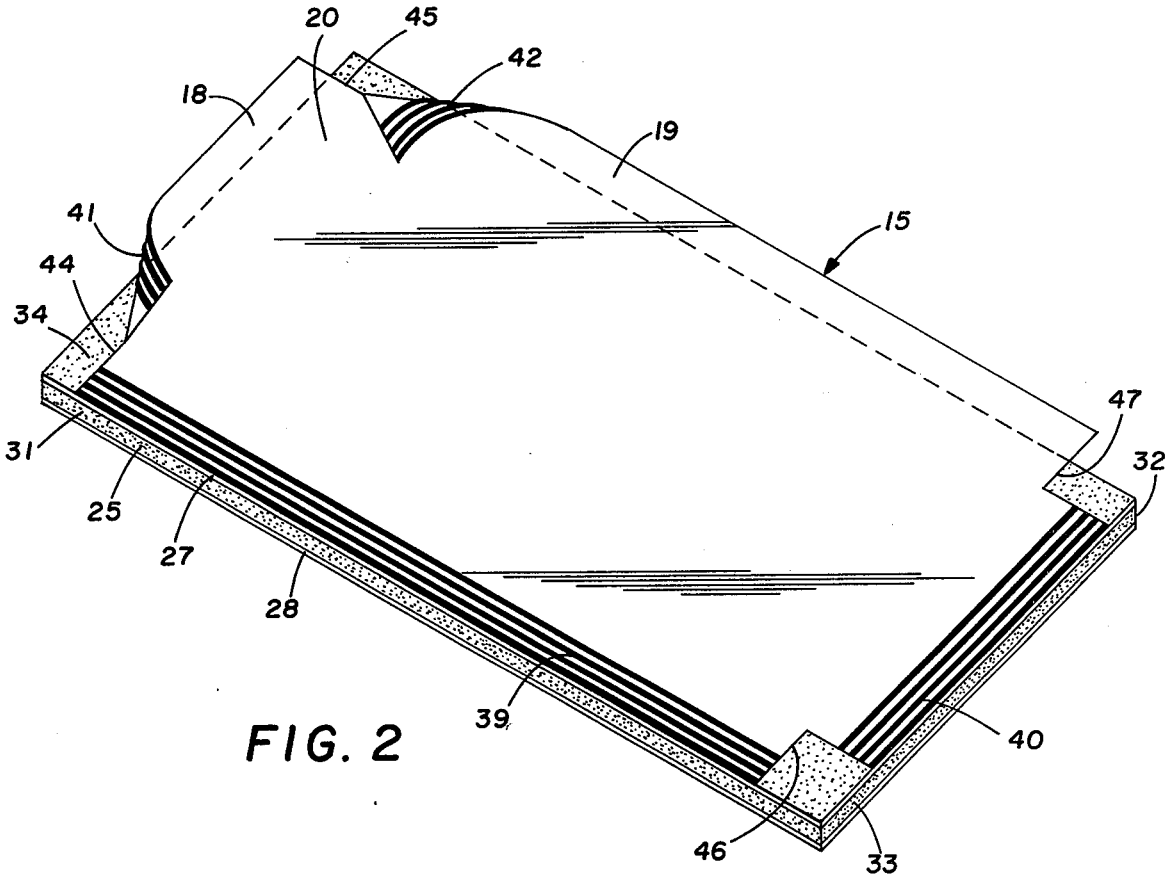
FIG. 2 is an enlarged perspective view of a single plank.

The construction assembly 10 includes a plurality of individual planks generally designated by the numeral 15. The appended letters *a, b* and *c* are used here and throughout the specification to denote separate components or elements of similar construction. In FIGS. 1 and 2, plank 15 is shown as being rectangular having opposite side edges 31 and 32 and opposite end edges 33 and 34. A number of similar planks 15 are contiguously aligned in a side-by-side and end-to-end arrangement to form assembly 10 with the individual planks abutting at common corner junctures 16. Planks 15 are covered with outer membrane sheet 20 of a weather resistant flexible material preadhered to the exterior surface providing a pair of adjacent edge portions or flaps 18 and 19 which extend beyond the corresponding plank edges and are adapted to overlap the marginal portion of the next adjacent plank. At the corner junction 16 of several planks, multiple layers of membrane overlay one another and are sealed by corner sealing structure 21. The edge seal and corner seal arrangement will be explained in detail with reference to subsequent drawing figures.

Referring to FIGS. 2 through 6 which illustrate the details of construction of plank 15, the individual plank is formed having a core 25 of a suitable material having good compressive, insulative, flexible and shear strength characteristics. For example, core 25 could be a urethane foam or a polystyrene. The upper surface of core member 25 is covered by sheathing member 27 and the lower or interior side of core member 25 is covered by sheathing members 28. Sheathing members 27 and 28 are typically a plastic or wood material suitably bonded or laminated to the opposite sides of core 25 which serve to give additional strength to the structure. Upper sheathing 27 also serves to provide a relatively hard, smooth underlay or surface beneath flexible membrane 20. Sheathing 28 may be provided with an appropriate decorative treatment when exposed within the building interior.

Upper sheathing 27 is covered with membrane sheet 20 in the form of a weather resistant material to protect and seal the roof system 10. Membrane sheet 20 is substantially coextensive with the upper surface of the plank along edges 31 and 33. Along adjacent edges 32 and 34, portions 19 and 18, respectively, extend laterally beyond the corresponding panel edge. Generally rectangular cutouts 44 to 47 are provided in the membrane at the corners of the plank. Membrane 20 is preferably a natural or synthetic rubber or plastic bonded or adhesively joined to the surface of upper sheathing member 27. Membrane 20, for example, may be of a material known under the tradename "Hypalon" manufactured by the DuPont Chemical Company. Other material such as a flexible, light gauge aluminium or galvanized sheeting may be used as a material for the membrane.

Figure 6:
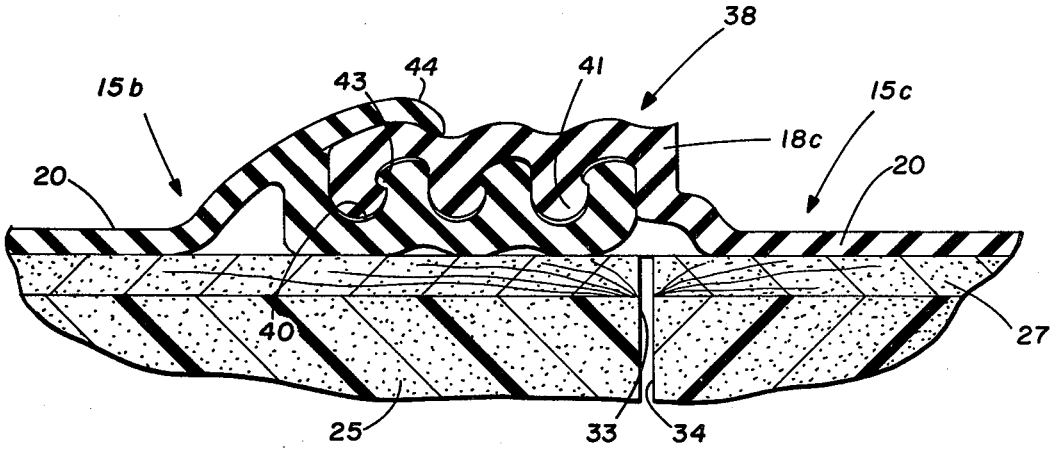
FIG. 6 is an enlarged sectional view taken along lines 6—6 of FIG. 1 showing the interlocking fastener members.

The closure assembly, shown engaged in FIG. 6 and typical of the closure along either the longitudinal edges 31, 32 or transverse edges 33, 34, is generally designated by the numeral 38. Closure member 38 includes parallel longitudinal groove members 39 extending the upper surface of membrane 20 immediately adjacent plank edge 31 and transverse grooves 40 extending in membrane 20 parallel to edge 33. The underside of membrane flap portions 18 and 19 are respectively provided with a corresponding number of downwardly projecting hook-shaped rib sections 41 and 42 adapted to coact and engage parallel groove members 39 and 40 when the panels are assembled. The ribs and grooves of closure 38 are adapted to interlock when force is applied, for example, to member 41 forcing the ribs into the grooves 40. The coacting sections are thus capable of being interlocked in zipper fashion to form a tight mechanical seal. As seen in FIG. 6, a loose flap of material 44 may extend along the membrane inward of grooves 39 and 40. Flap 44 is of sufficient width to overlap the seam of engagement of the rib and groove members. The purpose of the flap is to serve as a "kick" flap to prevent mechanical separation of the fastener components due to traffic across the membrane surface.

Various configurations of the ribs and grooves are suitable for the fastener arrangement. Generally the configuration includes a lateral projection such as lip 43 on ribs 41. The preferred configuration of this general type of fastener is shown and described in U.S. Pat. No. 3,373,464.

Closure 38 can easily be engaged by workmen as the panels are assembled to form a weatherproof and waterproof seal. In some instances an adhesive or vulcanizing agent can be applied between the coacting grooves and ribs at the time of securing the overlying membranes together to further ensure against penetration of moisture and seal the interior plank structure.

Figure 3:
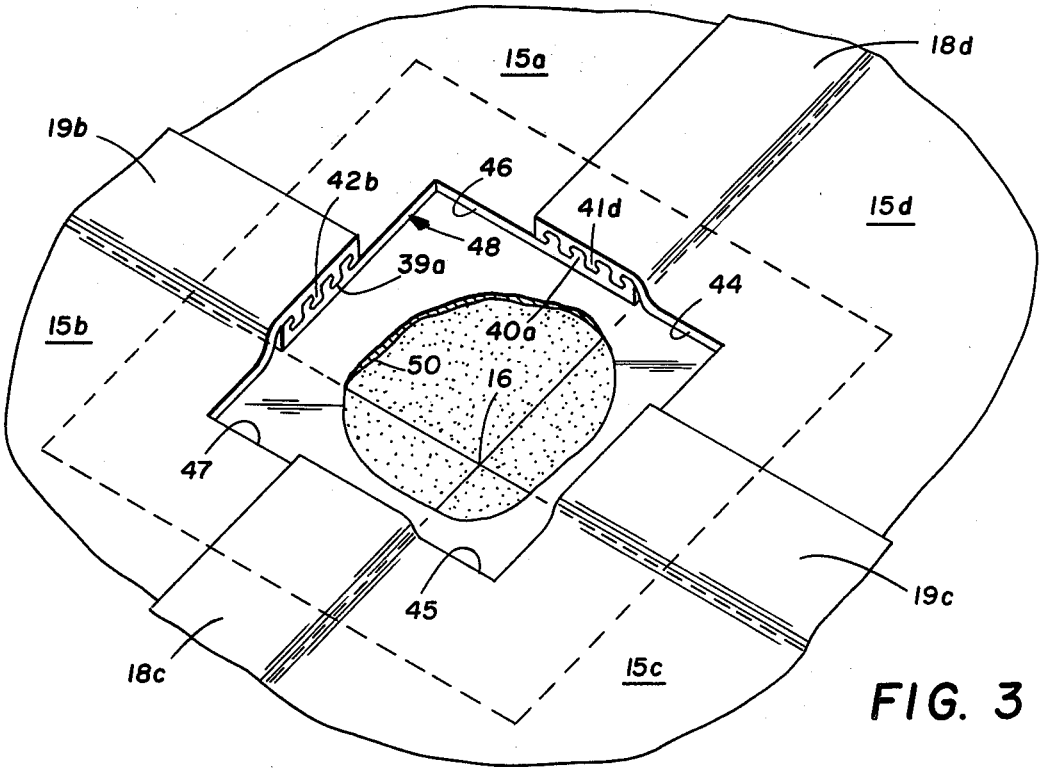
FIG. 3 is an enlarged partial detail view in perspective showing the relationship of the overlapping membrane members at a four corner junction.

A special overlapping condition exists at the juncture of three or more panels as for example, at corner 16 which is sealed by a special corner structure seal 21. FIG. 3 illustrates the overlapping condition in better detail having a typical corner between planks 15*a*, 15*b*, 15*c* and 15*d*. A transverse edge seal is formed between adjacent planks 15*a* and 15*d* by the closure member formed by the ribs 41*d* on the underside of flap 18*d* engaging grooves 40*a* between the panels. Similarly flap 19*b* overlies and interlocks with grooves 39*a* of panel 15*a* to form a longitudinally extending edge seal between the adjacent edges of panels 15*a* and 15*b*. A laterally extending seal is formed between adjacent panels 15*c* and 15*b* by the interlocking relationship of the ribs on the underside of flap 18*c* interlocking with the grooves at the edge of panel 15*b*. Flap 19*c* overlies the marginal edge portion of panel 15*a* forming a longitudinally extending seal between panels 15*c* and 15*d* which are arranged in side-by-side relationship. Thus it will be observed that longitudinally and transversely tight edge seals are provided extending from the corner junction of the four abutting panels. Note that the outermost rib and groove members of the closure assemblies 38 cooperate at a location immediately inward of the edge of the flaps 18 and 19. With a full line seal formed along the marginal edges of the respective closure carrying flaps, moisture is prevented from entering under the flap in following a path beneath the flap either transversely or longitudinally to the rectangular opening 48 formed by the cutouts 44–47 at the corner of the membranes.

Figure 4:
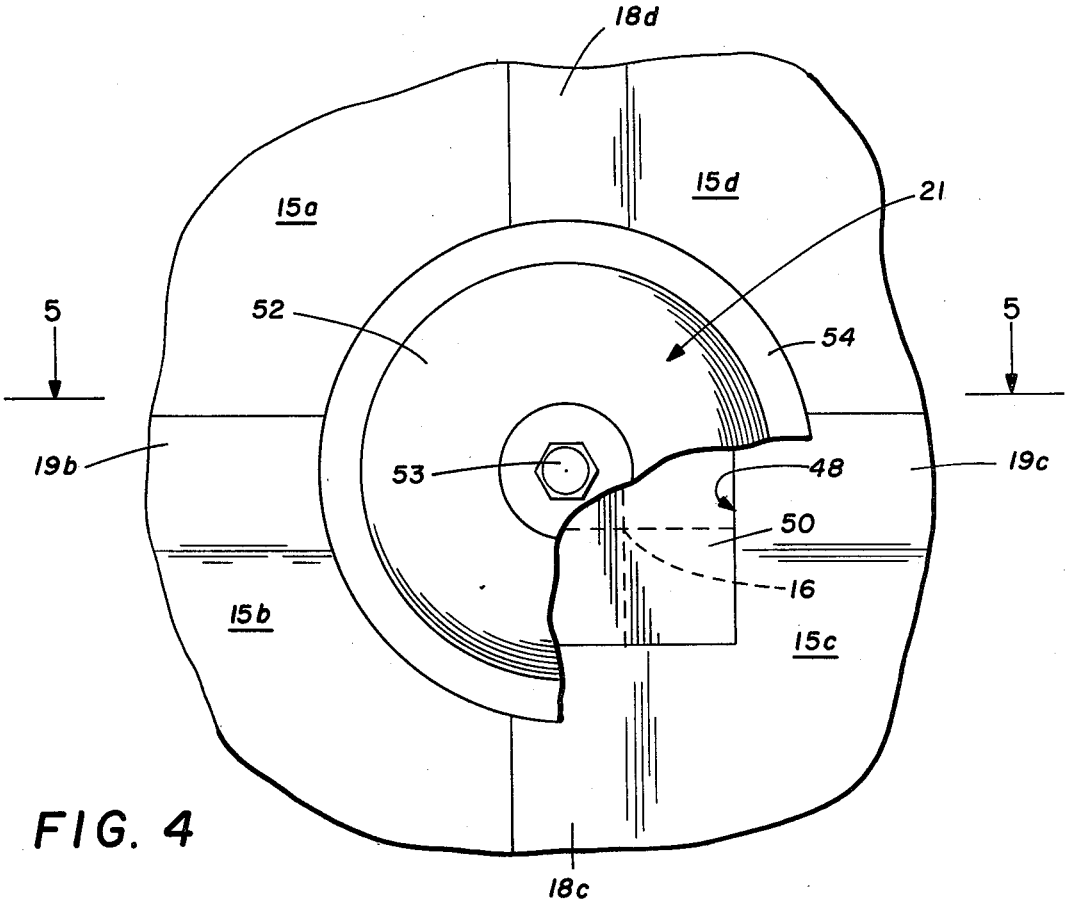
FIG. 4 is an enlarged fragmentary plan view of a corner joint at the junction of the adjacent panels showing a sealing member in place.
Figure 5:
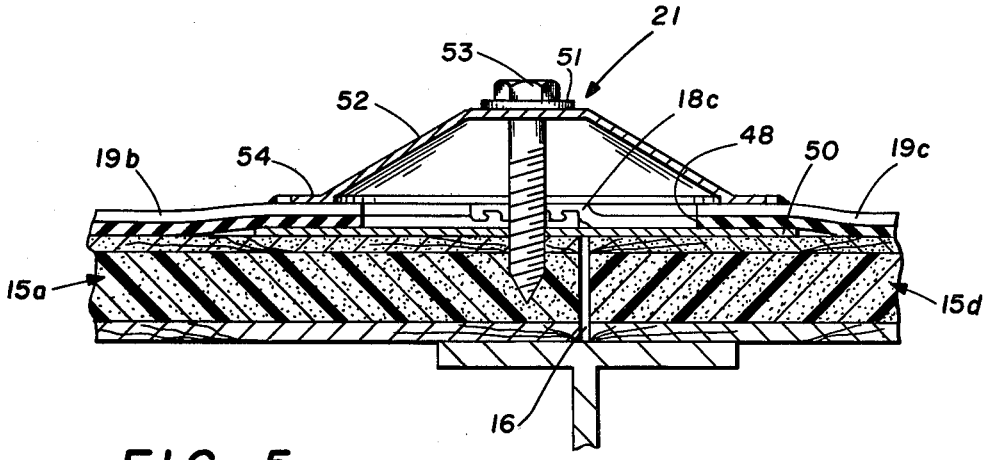
FIG. 5 is a sectional view taken along lines 5—5 of FIG. 4.

The sealing of the construction assembly 10 is completed by sealing around the opening 48 at the juncture of the panels. The corner seal is shown in FIGS. 4 and 5 and is generally designated by the numeral 21. The exterior side of the corner joint 21 is defined by a generally convex compression member 52 having an annular lip portion 54. A fastener 53 extends through member 52 and into flat bearing plate 50 and subjacent plank 15*a*. Neoprene washer 51 seals between the fastener 53 and member 52. Bearing plate 50 is located at the panel corner 46 and may be located above or below sheathing 27 and, as shown, may be of sufficient size to overlap the adjacent planks. Preferably plate 50 is formed as an integral part of the plank at the factory to minimize field assembly operations. Tightening of the mechanical fastener 53 will draw member 52 down, compressing the lapping membrane sections together. Annular lip 54 of the member 52 completely encompasses cutout area 48 so that a continuous seal exists between adjacent longitudinal and transverse edge seals. The area of bearing plate 50 and the area encompassed by compression member 52 should be large enough to also provide for any misalignment which might occur in assembly of the plank sections. To further ensure the integrity of the seal formed by member 52 a suitable mastic or sealant may be placed around lip 54. Thus an efficient, easy to install watertight and weatherproof seal is formed across the upper surface of the planks. The cooperable closure members 38 define a highly effective watertight seal at the very outer edge of the respective flap portions 18 and 19 carried on the planks 15. This prevents any water from entering beneath the flap portions and following a path along either the longitudinal or transverse plank edges to cutout area 48. Seal 21 including member 52 serves to completely enclose and seal cutout area 48 and prevents entrance of moisture and serves as a bridge between adjacent edge seals.

Member 52, fastener 53 and plate 50 are preferably of a heat conductive metal. Once the joint is assembled, heat may be applied to member 52. Heat will be transferred via fastener 53 to the underside of the joint and as edge 54 and plate 50 are heated, the compressed membrane layers will become heated and bond to one another and to members 52 and 50. The additional optional step of heat bonding further ensures the integrity of the seal.

If edge closure 38 were constructed so that the effective line of seal between abutting panels were substantially inward of the outer marginal edge of the overlying flap portion, it would be necessary to provide a barrier to moisture or water between the closure members at the edge of cutout 48 beneath annular lip 54. For example, if the edge seal were defective between the outer grooves and the ribs 39*a* and 42*b* on the underside of flap 19*b*, water could enter beneath flap 19*b* and flow longitudinally into cutout 48. It will be observed that member 52 serves primarily only to seal at the exterior surface of the membrane between the edge seals and, unless extreme compression were applied, would not ensure the effectiveness of the seal transversely across flap 19*b*. For this reason it is important to ensure a seal at the outer edges of flaps 18 and 19. Addition of mastic or other sealants in the clousure members 38 may be desirable. Thus the combination of the edge seal at closure 38 between adjacent panels and the corner seal 21 must be effective to seal the entire exterior surface of the membrane by sealing marginally along the flaps 18 and 19 of the closure and also transfer the seal between adjacent closures. Alternately, the surface can be sealed inwardly of the margin of the flaps if an effective barrier is provided transversely across the adjacent closures 38 around the exterior surface of opening 48 directly beneath the lip 54 of the member 52.

Figure 7:
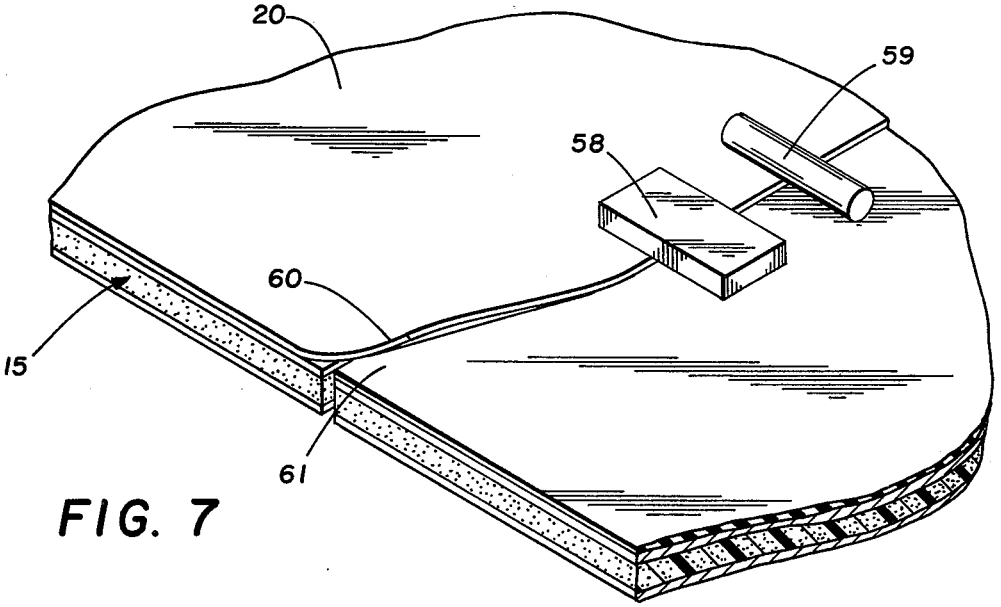
FIG. 7 illustrates an alternate form of the edge seal.

FIG. 7 shows an alternate form of the flap portions and of the membrane. In this structure the plank 15 and membrane 20 generally are formed as shown in FIG. 2. However, in this structure the plank flap and marginal sections 60 and 61 are formed without the groove and rib closure and are adapted to be sealed to the adjacent panel marginal membrane portion by vulcanization or other bonding methods. The material of the membrane is preferably a natural or synthetic rubber or a thermosetting resin which characteristically is adaptable to vulcanization or upon application of heat fuses or joins. The planks are assembled with the flaps 60 overlying the marginal portion 61 of the adjacent panel membrane. The membranes are sealed together by application of heat and/or heat and pressure along flaps 60 and 61 with a heating unit 58 which is shown as a flat iron having an appropriate temperature control. Following the application of heat a pressure member 59, shown as a weighted roller, serves to compress the cooperating membrane members together to ensure a good seal. The temperature applied at the flaps should be sufficient to at least partially melt the upper membrane flaps so that the underlying layers are heated and bonded to the flaps. It will be noted that in this way a good seal is provided between adjacent planks so that water cannot enter under the flap and follow a path either directly to the crevice between the adjacent panels or follow a path along the seal and enter the cutout area 48 at the corner area. The vulcanizable seal is cooperable with the corner seal 21 which provides a complete seal in the exterior surface of the panels. Bonding can also be effectuated by application of electric, magnetic, sonic or heat waves, to cause molecular bonding.

Figure 8:
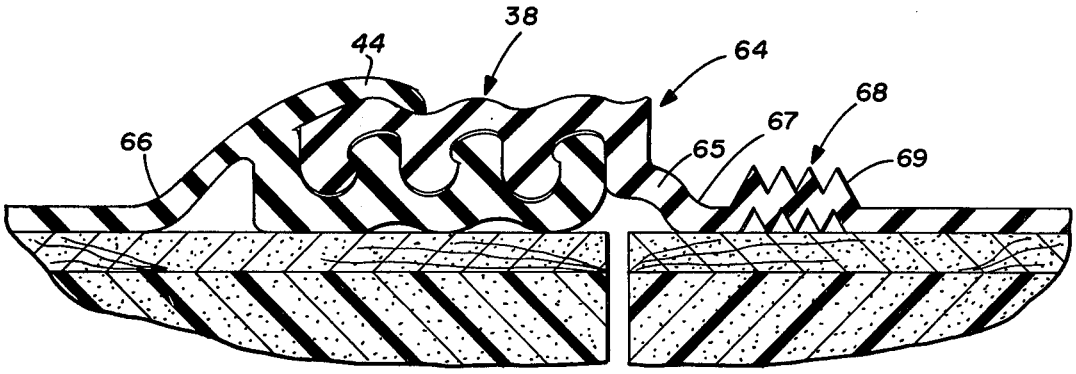
FIG. 8 is a cross-sectional view of another embodiment of the interlocking fastener.

FIG. 8 shows still another embodiment of the edge seal between adjacent panels. In this embodiment, generally designated by the numeral 64, the closure member 38 again comprises interlocking rib and groove members carried on membrane flaps and marginal edges 65 and 66 of adjacent panels. Membrane flap 65 is bonded to the upper surface of the plank leaving a loose selvage 67 adjacent the panel edge. In the area of selvage 67 the membrane is formed into an expansion joint 68 having a plurality of ribbed accordion-like member 69 or similar configurations that allow for expsnsion and contraction. When the panels are assembled and the membrane edge seal secured, misalignment at the time of installation can easily be accommodated at expansion joint 68. Expansion joint 68 is in tension and the membrane will remain taut across the upper surfaces of the adjacent planks.

Figure 9:
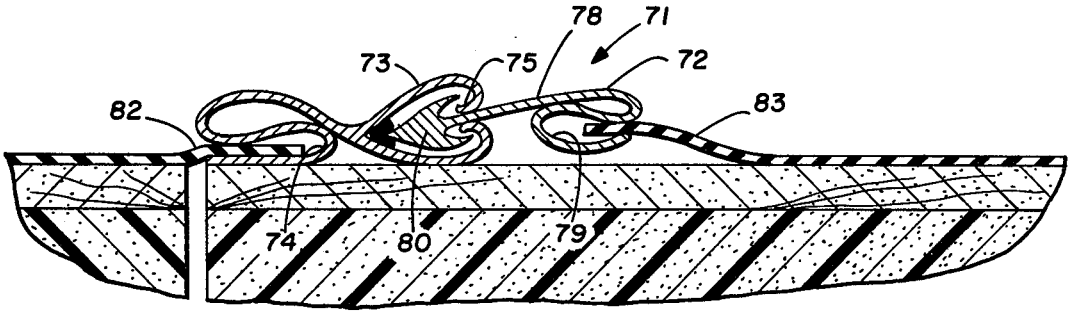
FIG. 9 is a cross-sectional view showing an alternate embodiment of the interlocking membrane fastening member.

FIG. 9 shows still another embodiment or form of the edge seal between the adjacent planks. The embodiment of FIG. 9 is generally designated by the numeral 71 and includes interlocking male and female members 72 and 73 which are engageable and which each respectively are secured to a membrane edge. Male member 72 is shown associated with membrane edge 83 and female member 73 is shown associated with membrane 82. The embodiment of the fastener shown is preferably formed of a light gauge metal and adaptable for use with either a plastic or light gauge metal membrane. Female or socket member 73 is formed having one edge reversely bent to form a longitudinally extending channel 74 which is adapted to accept the terminal edge of the associated membrane 82. Socket 73 is formed with an opening defined by inwardly turned ribs 75. Male member 72 is formed having a longitudinally extending channel 79 adapted to receive the terminal edge of associated membrane 83. An intermediate stringer portion 78 carries an enlargement 80 which is preferably in the form of a barb engageable within socket 73. Preferably socket 73 contains a quantity of factory applied mastic or sealant.

When the individual planks are fabricated, one or more edges 82 of the membrane are provided with the socket or female member 73 with the terminal edge of the membrane compressed within channel 74. Similarly the opposite cooperating edges 82 of the membrane are secured to the fastener element member 72 at its channel 79, the channel being suitably crimped about the terminal edge of the membrane. When several panels are placed in contiguous, aligned relationship the exterior membrane covering is sealed by inserting barb member 80 within socket 73, socket ribs 75 being resiliently separable to accommodate the barb. Mastic within the socket further ensures a tight seal and prevents leakage across the seal. Both members 72 and 73 are adapted to be easily extruded by conventional metal working machines. The material of the fastener elements 72 and 73 is preferably an extruded aluminum or similar metal. The corner seal described above is adaptable for use with an edge seal 71. Members 72 and 73 are appropriately crushed or crimped at the corner by a hammer blow and by mechanical compression of the corner joint members.

Figure 10:
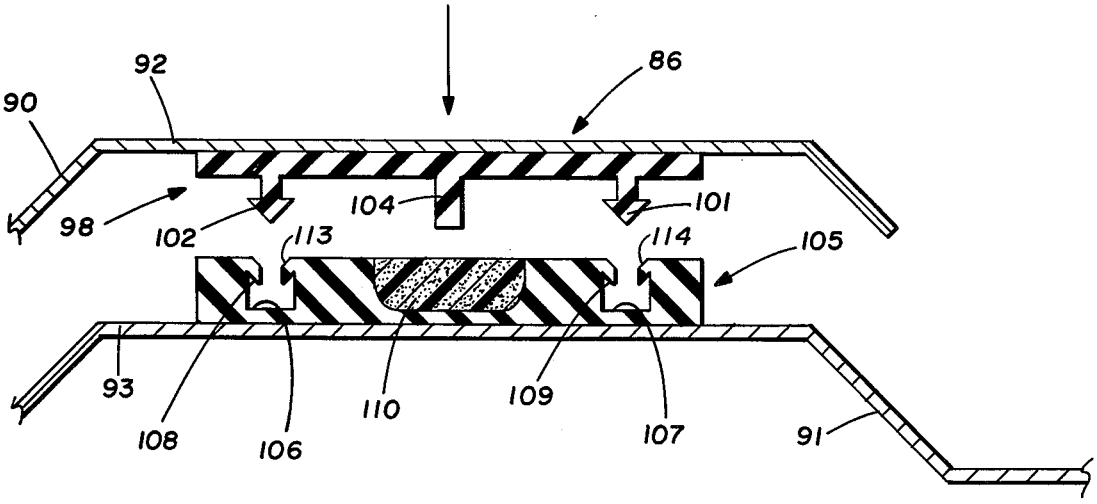
FIG. 10 shows the use of the interlocking fastener members as applied to conventional metal building panels.

FIG. 10 shows still another aspect of the present invention. In the embodiment of FIG. 10 generally designated by the numeral 86, construction panels 90 and 91 are shown as conventional metal panels having overlapping corrugations 92 and 93 respectively. The interior of corrugation 92 carries male fastener portion 98 and the exterior surface of corrugation 93 carries cooperable female locking member 105 which together are engageable to form a weatherproof seal at the interface between panel sections 92 and 93. Fastener members 98 and 105 extend longitudinally and are adhesively bonded or otherwise affixed to the edge of the panel at the factory during the fabrication process.

Male closure member 98 is formed or extruded having longitudinally extending rib members 101 and 102 each having a barbed outer end projecting downwardly from opposite edges of fastener member 98. Generally rectangular rib member 104 projects downwardly intermediate barbed members 101 and 102.

Coacting closure member 105 is formed having longitudinally extending marginal grooves 106 and 107 spaced to receive rib members 102 and 101. The opening into grooves 106 and 107 is defined by overhanging ridge members 108 and 109 respectively. The openings between ridge members 108 and 109 are beveled or tapered at 113 and 114 to guide the insertion and engagement of rib members 102 and 101 into grooves 108 and 107 respectively. A longitudinal channel 110 extends intermediate the grooves 106 and 107. Preferably channel 110 contains a quantity of sealant or mastic. It will be seen that when fastener member 98 is aligned with fastener member 105 and pressure is applied to compress the cooperable members together, the barbed ends of ribs 101 and 102 will deform the overhanging ridge members 109 and 108 to permit the ribs to gain entry into the marginal grooves. Intermediate rib member 104 extends into channel 105 and the mastic contained in this channel. Once fastener member 98 is fully inserted in member 105, the overhanging ridges 108 and 109 assume an unstressed condition and engage the rear portion of the barb or hook members on ribs 101 and 102 to prevent reopening or separation of the fastener elements. The mastic or sealant further serves to prevent leakage of moisture laterally across the seal formed by the seal elements.

Figure 11:
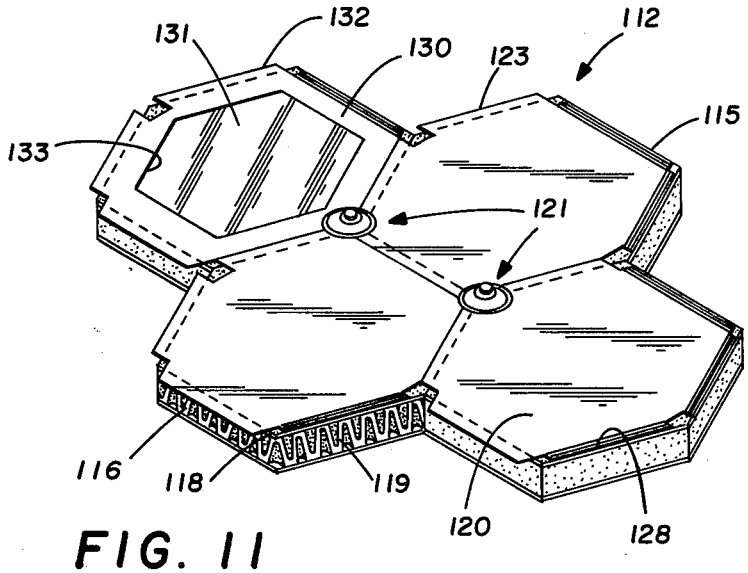
FIG. 11 is a perspective view showing a construction section formed of a number of construction planks of a polygonal shape and having a cellular plastic core structure.

FIG. 11 shows another embodiment of the present invention in which a construction assembly generally designated by the numeral 112 is comprised of a cooperating number of individual planks 115. In this embodiment the individual planks 115 have a hexagonal geometric shape rather than rectangular as shown in previous figures. Individual planks 115 are formed having a core material 116 which is shown as a sandwich panel having exterior and interior sheeting members 118 and 119 disposed against the opposite surfaces of core member 116. Core member 116 is shown as a honeycomb cellular plastic structure having a geometric configuration to yield good rigidity of flexural strength. Typical of a cellular core material of this nature is the cellular plastic honeycomb material manufactured by the Norfield Corporation of Danbury, Connecticut. Exterior sheathing and interior sheathing 118 and 119 are of a suitable plastic or light gauge metal which is adhesively bonded or laminated to the opposite surfaces of core 116 to provide a relatively hard, smooth surface which is necessary to provide the underlayment for the membrane covering 120. Membrane 120 is preadhered to the exterior surface of exterior sheeting 118 and carries flap portions 123 which extend beyond the edge portion of the core at three adjacent sides of the panel. The underside of flap portions 123 carries a flexible fastener rib member, not shown, which is cooperable with marginal groove portions 128 of adjacent planks. When the planks are arranged in aligned, contiguous relationship, as shown, flaps 123 overlie the marginal portion 128 of the next adjacent plank and may be sealingly engaged to the adjacent plank. The form of fastener may also be similar to those shown in FIG. 7 to FIG. 9.

If it is desired the planks can be fabricated to permit passage of light. Plank 130 is geometrically cooperable with planks 115 and is fabricated having a core 131 of transparent or translucent material. The membrane 132 is bonded or preadhered to the periphery of the exterior surface of the plank leaving a cutout 133 in the panel to permit entry of natural light to the building interior.

At the juncture or intersection of several planks an overlap condition exists which may be sealed by the corner seal 121 similar to seal 21 as shown in FIG. 4. It will be noted that the corner seal 121 is adaptable to use with the various geometric shapes and is usable at an intersection of three or more planks 115.

Figure 12:
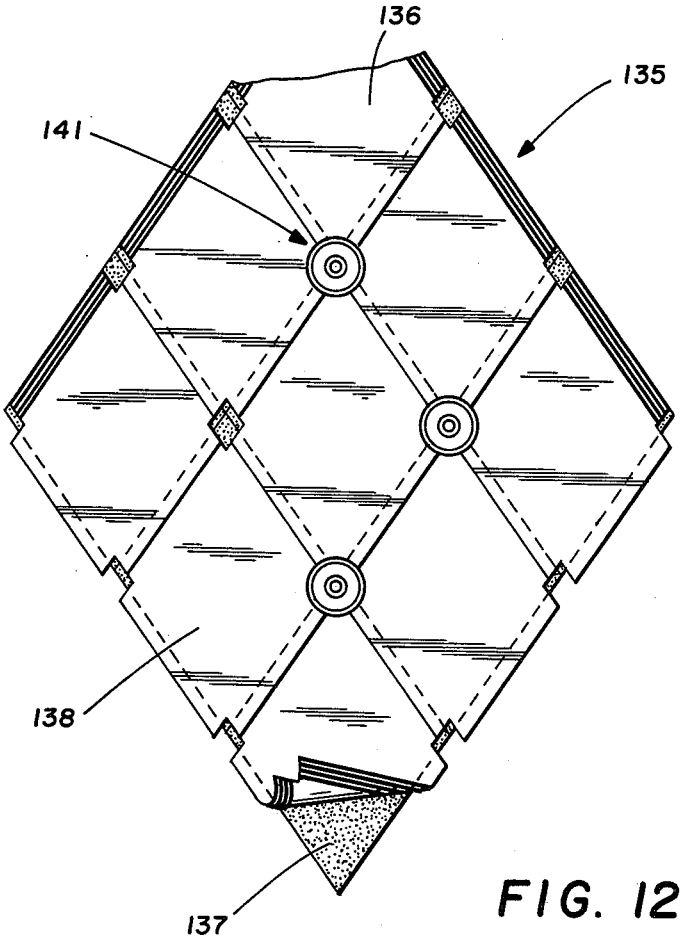
FIG. 12 is a plan view showing the construction of a roof section using concrete panels carrying the membrane covering.
Figure 13:
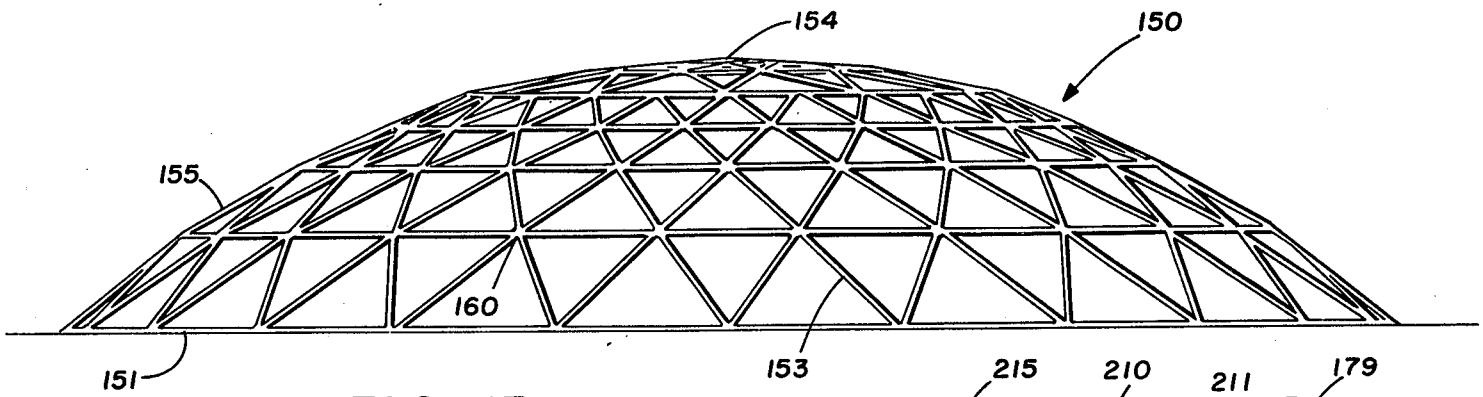
FIGS. 13 through 15 illustrate the system of construction for a geodesic dome using the plank members of the present invention.
Figure 15:
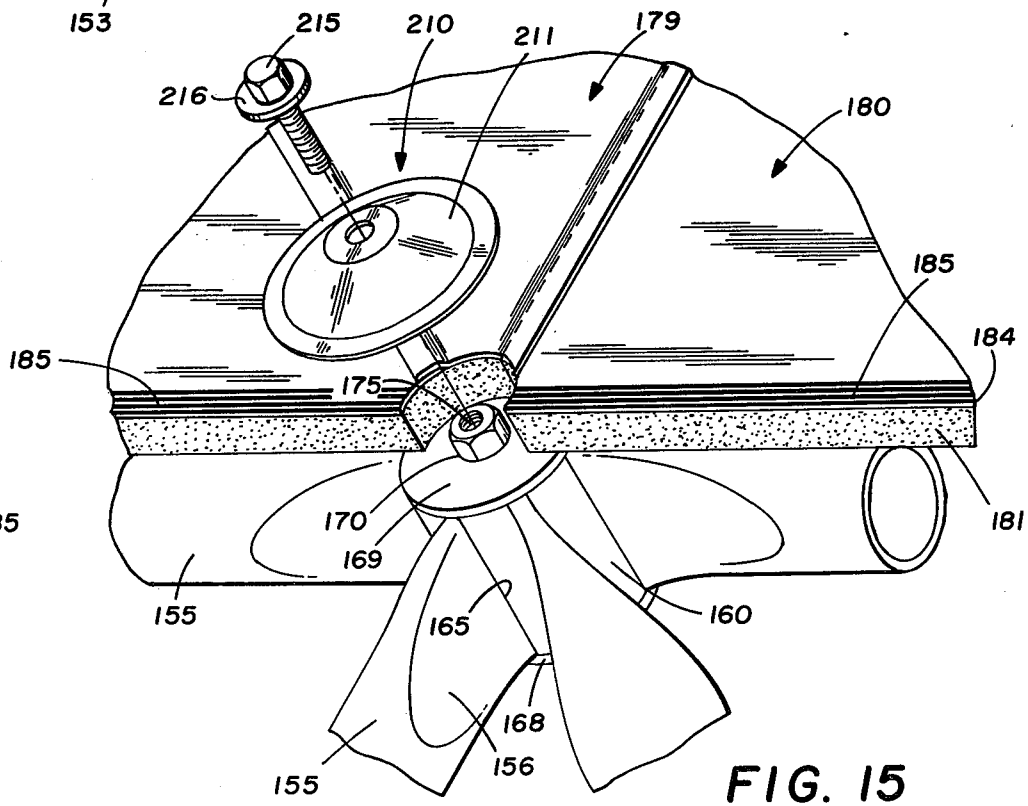

FIG. 12 shows still another form of plank section identified by the numeral 135 assembled to form a roof structure. Plank sections 136 are parallelograms having a shape to achieve more unusual architectural requirements. The individual concrete planks 135 have precast cores 137 and carry a membrane 138 preadhered or bonded to the exterior surface of the plank. Planks 135 are fitted together at the job site and the exterior sealed by the membrane carries a form of the flexible edge seal of the type described above. The corner seal 141, similar to seal 21, is adapted for use with this geometrical configured plank. Thus it will be seen that the plank can be almost any geometric shape and material and be usable with the integral membrane seal and edge and corner sealing structure.

FIGS. 13 through 16 show the construction system of the present invention as applied to the construction of a geodesic dome again illustrating the versatility of the system of the present construction system. The geodesic dome generally indicated by the numeral 150 has a supporting structure including a peripherally extending base ring or tension member 151. Base ring 151 serves as a connector for tubular structural members 155. Tubular structural members 155 are arranged to form a frame comprised of a series of annular tiers of triangular structural components 153 extending to the apex 154. Triangular structural sections 153 commonly intersect at connector hub members 160 with six tubular members 155 radially projecting from hub 160. Hub 160 is shown in detail in FIG. 15. Connector hub 160 is provided with six radially extending slots 165 which are adapted to receive the flattened ends 156 of tubular elements 165. When the tubular frame members 155 are fitted into the slots 165 of hub 160, washers 168 and 169 are secured in place at opposite sides of the hub to secure the frame members to the hub. Cooperating teeth in the slots 165 hub maintain the rigidity of the frame. Washers 168 and 169 are held in place by fastener 170 which is adapted to be received within a concentric bore in hub 160. The head of fastener 170 defines internal threaded bore 175.

Once the frame of the geodesic dome is constructed as described above, the roof cover is ready to be put in place. Conventional geodesic domes generally utilize a roof structure comprising a series of roof structure support angles secured to the frame hubs. Appropriate trusses extend across the roof support angles from the base to the apex of the dome. A covering of material such as form board is placed over the roofs support angles and the trusses. Wire reinforcing then covers the form board and a lightweight insulating concrete is applied over the entire surface of the dome. When the concrete is set up an exterior weathering membrane of a plastic or rubber material is applied over the surface of the concrete.

Figure 14:
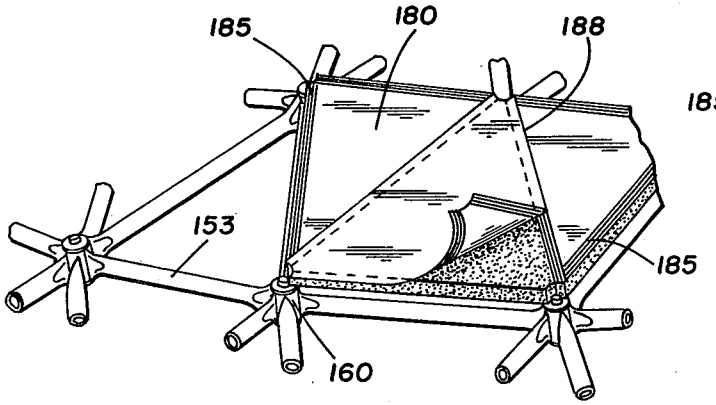

With the construction of the present invention, the roof is applied over the frame structure as a series of interlocking prefabricated planks. The necessity for extensive substructure reinforcing is eliminated as is a requirement for application of concrete and separate application of a weathering membrane. The individual roof plank sections 179 and 180 each comprise a core 181 of a suitable lightweight construction material such as a urethane, cellular plastic material, or lightweight concrete. The planks are configured to correspond to the triangular shape 153 defined by the tubular members 155 and having a slight exterior curvature. Core 181 is covered with a membrane 184 such as the flexible plastic or light gauge metal described above. To accommodate fastening of the adjacent membrane members, the planks are constructed with groove members 185 extending along the marginal edge at three sides of the planks. Cooperating panel 179 is formed having flap members 188 projecting beyond the edges of the plank. The underside of flaps 188 each carry a flexible fastener component adapted to be received in interlocking relationship with grooves 185 carried on adjacent planks 180. The rib and groove arrangement would typically be similar to the zipper arrangement described in FIG. 6. It will be seen that when the planks are arranged in contiguous, aligned arrangement as shown in FIG. 14, the flaps 188 carried on plnaks 179 will overlie and engage the grooves 185 carried on the adjacent planks 180. Thus a complete weathering membrane seal is effected at the joint between adjacent planks.

At the intersection of multiple planks a corner structure 210 seals this area. The edges of the individual planks at the area of the hub are supported on washer 169 and hub 160. Washer 169 is of sufficient size to bridge and support the corner. A sealing plate 211 is placed over the upper surfaces of panels and secured tightly to member 170 by fastener 215 received within bore 175. Fastener 215 serves to compress plate 211 tightly against the lapping membrane sections forming a watertight seal at this point. Mastic or sealant may be provided around the periphery of plate 211 to further ensure the integrity of the seal at this location. Washer 216 seals around fastener 215.

Thus it will be seen that the construction of the geodesic dome can rapidly proceed with the workmen simply placing the individual planks in place. Sealing is accomplished by engaging the edge membrane seals and placing the corner seals at the appropriate locations.

The construction system of the present invention provides a system which permits a variety of prefabricated structures to be quickly erected in a wide range of weather conditions. Ambient temperature is not critical as with application of materials such as bitumen. Because of the modular nature of the system, the planks can be placed and erected quickly to enclose a building in a minimum of time allowing crews to complete the interior work in a protected environment.

The plank, because of its unique structural design, provides a smooth, hard surface which is very resistant to exterior damage. As a roof member the plank is particularly advantageous as the hard, smooth surface directly under the weather resistant membrane provides support for the membrane and is resistant to exterior damage from foot traffic, weather and vibration. The plank of the present invention is particularly adaptable for use with a wide variety of accessories. The plank can be cut, sawed or bored to accept various fittings and accessories such as windows, ventilators, or conduits for electrical or mechanical accessories.

Other advantages to the construction system of the present invention reside in its light weight. Less supporting foundation for the structure is required because the weight of the planks is substantially less than the equivalent structure of concrete or block. The pre-finished exterior and interior permits fast installation and eliminates the need for additional work. The components of the plank, all being of a non-flammable or fire-resistant material, result in a structure with a good U factor with corresponding reductions in building and insurance costs.

The basic plank structure is particularly good as a structural member because it incorporates features which give it both good longitudinal and lateral and diaphragm strength. Factory assembly of the plank allows minimum labor cost and provides maximum quality control resulting in a more uniform economical product with reduced field maintenance problems. The plank is highly versatile and allows substantial various construction to meet various end needs such as strength, weight, thickness, fire characteristics and thermal conductivity. The plank is the fabricated or wide variety of geometric shapes such as rectangular, square or triangular, to accommodate almost any architectural requirement.

It will be obvious to those skilled in the art to make modifications and changes to the plank of the present invention. For example, it will be obvious to substitute other structural elements for the interior panel or core member. Similarly, various forms of insulation and interior and exterior panels can be used. The membrane may be of the wide variety of natural or synthetic materials to provide the desired weatherproof exterior and flexibility required for incorporating integral fastener members. To the extent these changes and modifications do not depart from the spirit and scope of the present invention, they are intended to be encompassed therein.

We claim:

1. A factory fabricated panel for producing a field erected watertight structure when combined with similar panels comprising:

a panel having a geometrically shaped watertight surface adapted to cooperate with other panels to form a structure in which the watertight surfaces of the panels form a generally continuous surface;

a sealing strip disposed along each of at least two adjacent edges of the panel and attached to the watertight surface along substantially the length of the respective edges of the watertight surface;

each sealing strip being capable of mechanically engaging a mating sealing strip on an adjacent panel to form a watertight seal;

each of said sealing strips terminating adjacent the common corner of the panel;

each sealing strip being disposed substantially at or above the watertight surface such that when the sealing strips are engaged with sealing strips of adjacent panels, the engaged sealing strips will be disposed substantially in the common surface whereby the ends of the sealing strips may be sealed by corner sealing means extending from the watertight surface of said panel across each engaged pair of sealing strips to the watertight surfaces of the adjacent panels to form a watertight structure.

2. The factory fabricated panel of claim 1 wherein the panel is a rectangular roofing member designed to bridge across at least two supporting structural members and bear a load and the watertight surface is formed by a flexible synthetic material bonded to an underlying planar member capable of resisting damage by foot traffic over the roof.

3. The factory fabricated panel of claim 2 wherein there is a sealing strip disposed along each of the four edges of the panel, the sealing strips along two adjacent edges overlay the surface of the planar member and have upwardly facing mechanical fastener means, and the sealing strips along the other two adjacent edges have downwardly facing mechanical fastener means disposed beyond the margin of the planar member.

4. The factory fabricated panel of claim 2 wherein one sealing strip has at least one upwardly facing groove for receiving a downwardly facing rib on the sealing strip of an adjacent panel and means extending along the sealing strip adjacent the groove for preventing accidental displacement of the rib from the groove by a horizontal force component directed against the edge of the sealing strip carrying the rib.

* * * * *